United States Patent [19]

Chang

[11] Patent Number: 4,964,425

[45] Date of Patent: Oct. 23, 1990

[54] STRUCTURE OF AN ASHTRAY, CAPABLE OF SELF-CLEANING AND AUTOMATIC FIRE-EXTINGUISHING

[76] Inventor: Hui-Hsiung Chang, No. 10, Hsin Kung 4th Road, Tien-Chung Chen, Changhua Hsien, Taiwan

[21] Appl. No.: 184,458

[22] Filed: Apr. 21, 1988

[51] Int. Cl.[5] ..... A24F 13/18

[52] U.S. Cl. ..... 131/237; 131/242

[58] Field of Search ..... 131/231, 238, 235.1, 131/237, 242

[56] References Cited

U.S. PATENT DOCUMENTS

| | | | |
|---|---|---|---|
| 589,152 | 8/1897 | Baker | 131/242 |
| 1,912,598 | 6/1933 | Snadden | 131/237 |
| 2,589,989 | 3/1952 | Brunsvold | 131/237 |
| 2,626,616 | 1/1953 | Buroker | 131/237 |
| 2,661,747 | 12/1953 | Manion | 131/237 |
| 2,989,964 | 6/1961 | Willett | 131/237 |
| 3,651,817 | 3/1972 | Baker | 131/237 |
| 3,695,277 | 10/1972 | Moffa | 131/237 X |
| 4,055,193 | 10/1977 | Lehman | 131/241 X |

*Primary Examiner*—V. Millin
*Assistant Examiner*—D. F. Crosby
*Attorney, Agent, or Firm*—Klein & Vibber

[57] ABSTRACT

A structure of ashtray, capable of self-cleaning and automatic fire-extinguishing, comprising a housing with an opening extending through the upper, the lower, the left and the right side, and with a cylindrically shaped body disposed in the center of the housing with a dust collecting drum mounted inside said cylindrically shaped body. The dust collecting drum has a plurality of collecting chambers and can be turned to revolve by means of a rotatable shaft so that any cigarette butt or garbage that is thrown inside can slide into a container attached beneath the housing and closely covered by said dust collecting drum during the time while the dust collecting drum is turned so that any burning cigarette butt that slides into the container will be promptly and automatically extinguished due to lack of air.

2 Claims, 3 Drawing Sheets

STRUCTURE OF AN ASHTRAY, CAPABLE OF SELF-CLEANING AND AUTOMATIC FIRE-EXTINGUISHING

BACKGROUND OF THE INVENTION

Field of the Invention

The present invention provides a structure for an ashtray and more particularly an ashtray that is capable of self-cleaning and automatic fire-extinguishing. This object is achieved by means of a revolvable dust collecting drum placed inside the housing of the ashtray to transport the ashes, cigarette butts or any other garbage that is thrown into the ashtray into a container attached below the ashtray so as to keep the upper surface of the ashtray clean at all times. The revolvable dust collecting drum has a plurality of collecting troughs and is operated to revolve by means of a rotatable shaft which extends through a axial bore of the dust collecting drum with both ends respectively protruding beyond the housing of the ashtray for the convenience of operation. The inner space of the container becomes an air-tight space and any burning cigarette butt that is thrown into the ashtray and transmitted to the container will be promptly and automatically extinguished due to lack of air.

Description of the Prior Art

Normally, while smoking at home or in a room, people usually use an ashtray to collect the ashes and the burning cigarette butts. However, this kind of conventional ashtray can only serve as a heat-proof disc-like container which cannot keep the surface of the ashtray clean and cannot automatically extinguish the burning cigarette butt. The smoke thus produced will cause air pollution even if one has stopped smoking. Moreover, if there is any negligence during placement of the burning cigarette butt, this may cause combustion of inflammable materials such as paper, etc., that are in close proximity, or may even cause a conflagration.

There is also known another kind of ashtray which is available in the marketplace, the structure of this known ashtray is mainly composed of a base and an upper plate for collecting ashes and cigarette butts in such a way that the ashes and cigarette butts thrown into the upper plate can be transferred into the base by means of a controlling mechanism opening the upper plate. This kind of structure can keep the surface of the ashtray clean, but any burning cigarette butt being thrown inside the base cannot be automatically extinguished, and the user must pay special attention to any burning cigarette in order to prevent a fire. Therefore, it is still not a perfect design.

SUMMARY OF INVENTION

In view of the above-mentioned problems, the object of the present invention is to provide a structure of an ashtray that is capable of self-cleaning and automatic fire-extinguishing, extinguishing. The novel ashtray comprises a housing that has an upper opening and a lower opening for a reel-like dust collecting drum for collecting ashes, cigarette butts or any other garbage thrown inside of the same, and for transporting the contained ashes, cigarette butts and garbage into a container attached below the housing. The dust collecting drum has a plurality of collecting troughs arranged around the central core of the dust collecting drum. The dust collecting drum is in close contact with the inner wall of the housing making the inner space of the container mounted below the drum to become an air-tight space so that any burning cigarette butt transported thereinside will be promptly and automatically extinguished.

Another object of the invention is to provide an ashtray that is capable of self-cleaning and automatic fire-extinguishing, wherein the ashes, cigarette butts or garbage that, are thrown into the upper opening of the ashtray will be transported into the container therebelow and the specific trough of the dust collecting drum that transports the ashes, cigarette butts and garbage will then be turned to face upwardly against the upper opening of the housing again in clean condition. This is achieved by manually revolving the dust collecting drum is revolved.

A third object of the present invention is to provide a structure of an ashtray that is capable of self-cleaning and automatic fire-extinguishing, wherein the revolving operation of the dust collecting drum is simply conducted by means of the the manual turning of a rotatable shaft which extends through the central core of the dust collecting drum with both ends protruding bilaterally beyond the housing of the ashtray.

BRIEF DESCRIPTION OF THE DRAWING

The foregoing and other objects, features and advantages of the present invention will be best understood from the owing description, the appended claims and the accompanying drawings in which:

DETAILED DESCRIPTION

Figure 1:
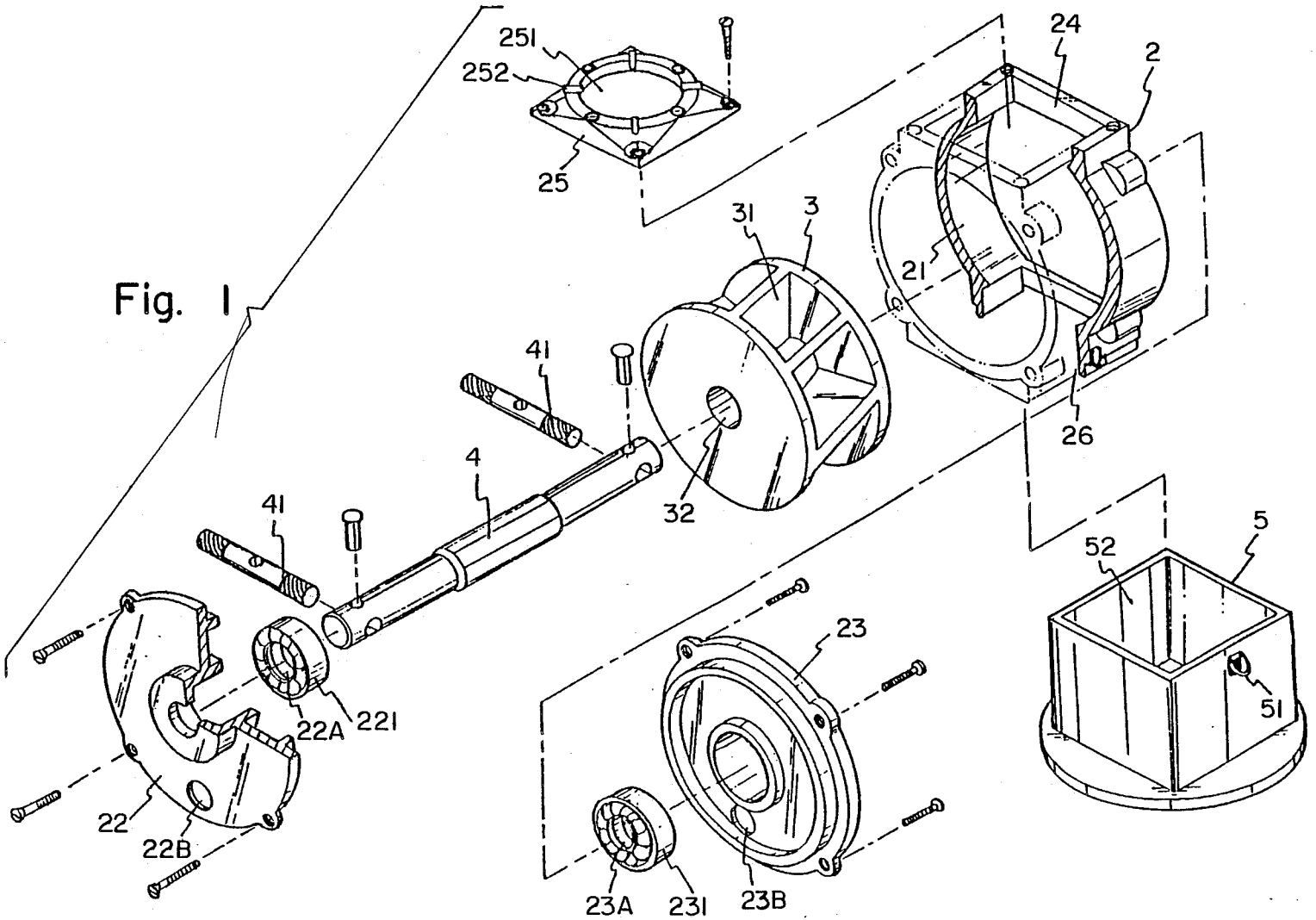
FIG. 1 is a fragmentary perspective view of an ashtray embodying the present invention.
Figure 2:
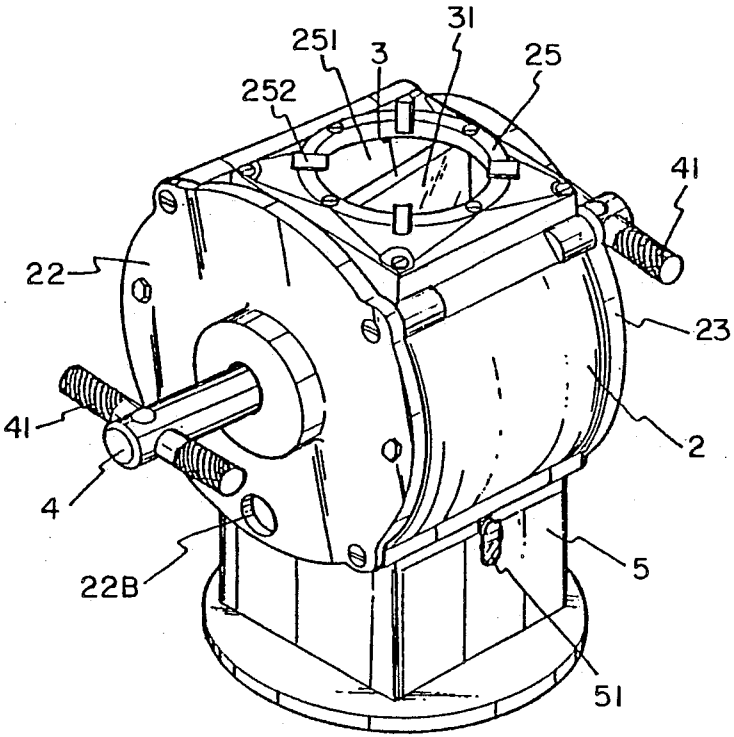
FIG. 2 is an assembly view of the structure of the preferred embodiment.
Figure 3:
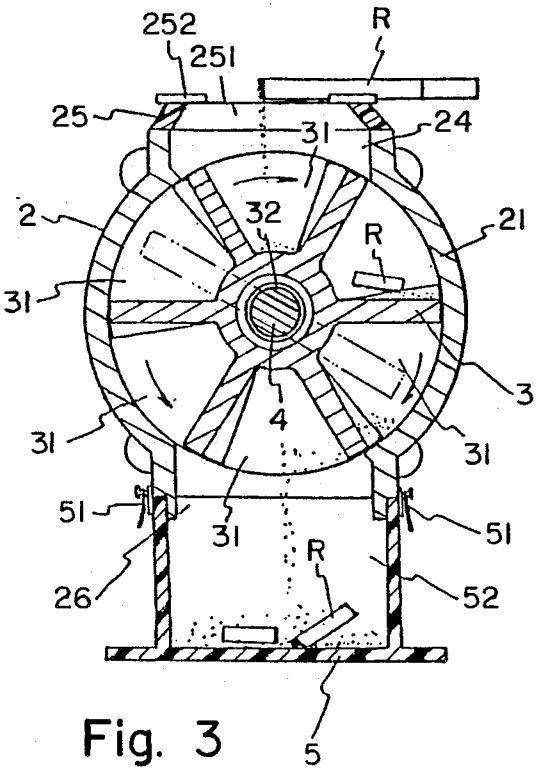
FIG. 3 is a cross-sectional view of the preferred embodiment in application.

As shown in FIG. 1 and FIG. 2, the present invention is composed of a hollow housing 2, a dust collecting cylindrical drum 3, a rotatable shaft 4 and a container 5 which is mounted below the housing 2. The housing 2 has a partially cylindrically shaped frame body having upper, lower, left-side and right-side openings. The middle part of the housing 2 is a cylindrically shaped portion 21 for receiving said dust collecting drum 3 thereinside. A side cover 22, 23 is respectively placed at each side of the cylindrically shaped portion 21 by means of a locking pin. Each side cover 22, 23 has a bearing 221, 231 and each side bearing 221, 231 has a respective axial bore 22A, 23A for a rotatable shaft 4 to be respectively inserted thereinto. Said housing 2 has an upper opening 24. An upper cover 25, comprising a frame plate 252, is mounted above said upper opening 24. Said frame plate 252 has an upwardly facing inlet 251 at its center and a plurality of curved radial grooves disposed around the inlet for holding cigarettes. By means of the above arrangement, ash dust and cigarette butts can be thrown into the housing 2 through the inlet 351. The housing 2 also has a lower opening 26 and a fastening element 51 which is mounted on the wall of the container 5 and on the housing 2 to connect the container 5 to the bottom of the housing 2 (FIG. 3). Said container 5 has an interior chamber 52 for the collection of ashes, cigarette butts.

Said dust collecting drum 3 is a reel-like shaped disc plate, having a plurality of outwardly inclined collecting chambers 31 arranged around the core of the dust collecting drum 3. The dust collecting drum is to be placed inside the housing between the upper opening 24 and the lower opening 26 in such a way that the opening of one of the collecting chambers 31 confronts the upper opening 24 of the housing 2 for the collection of ashes, cigarette butts or garbage R that has been thrown into the housing 2. When the dust collecting drum 3 is rotated, the garbage R that is contained in the collecting chambers 31 falls into the chamber 52 of the container 5 through the lower opening 26. As soon as the garbage R that is collected in the container 5 has accumulated up to a reasonable volume, the container 5 can be taken away for cleaning.

The revolving action of the dust collecting drum 3 is controlled by a rotatable shaft 4 that is inserted in into a bore 32 of the dust collecting drum 3 with both ends respectively projecting from the bore 22A, 23A at each side cover 22, 23. Each end of said rotatable shaft protruding beyond the housing 2 can be respectively attached to a handle bar 41 for convenient control. Each said side cover 22, 23 also has a respective air hole 22B, 23B to facilitate the rotating of the dust co e ting drum 3 by assuring ambient air pressure external to dust collecting drum 3.

Each of said collecting chambers 31 of the dust collecting drum 3 has a wider opening and narrower bottom so that each side wall of each collecting trough 31 inclines outwardly to facilitate the depositing of the garbage R contained by the collecting chamber 52 while the specific collecting chamber 31 is turned downward.

During application, the user throws ashes, cigarette butts and other garbage R into the collecting chamber 31 of the dust collecting drum 3 through the inlet 251 of the upper cover 25 and the upper opening 24 of the housing 2. The user then turns the rotatable shaft 4 letting the specific collecting chamber 31 face downward with its opening facing against the lower opening 26 and repeats this process. In this way, the garbage R, which is contained in the specific collecting chamber 31, is completely deposited downwardly into the chamber 52 of the container 5 through the lower opening 26. By means of this process, the inlet 251 can always be kept clean.

Because the dust collecting drum 3 is mounted inside the housing 2 with its periphery closely and tightly in contact with the surface of the inner wall of the housing 2, the container 5 below the dust collecting drum is hermetically sealed by the side wall of the dust collecting drum 3 allowing the chamber 52 of the container 5 to be an air-tight space and preventing outside air from penetrating into said air-tight space. Therefore, when any burning cigarette butt is thrown into the container 5, it will soon be extinguished due to lack of air so as to provide the advantage of a fire-proof effect.

Figure 4:
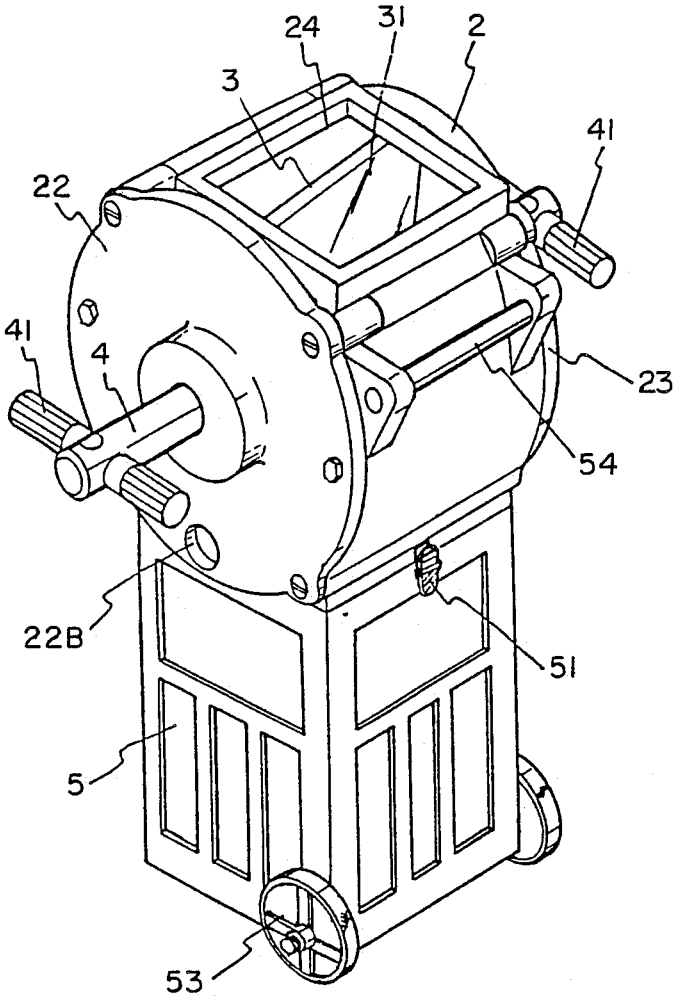
FIG. 4 illustrates another preferred embodiment of the present invention for use an as ashcan.

FIG. 4 shows a further embodiment of the invention achieved by taking away the upper cover 25 and respectively and proportionally enlarging the components of the housing 2, the dust collecting cylindrical drum 3, the rotatable shaft 4 and container 5 and letting the container 5 be in, e.g. cylindrical shape, with rolling wheels 53 attached thereto. The present invention thus assembled can be used as an air-tight ashcan with non-porous, vermin-proof and odor-proof features. Moreover, the housing 2 can also include a horizontal handle bar 54 which is firmly attached handle bar 54 for manual maneuvering of the said ashcan.

Although the invention is described and illustrated with reference to a plurality of embodiments thereof, it is to be expressly understood that it is in no way limited to the disclosure of such preferred embodiments but is capable of numerous modifications within the scope of the appended claims.

I claim:

1. A structure of ashtray capable of self-cleaning and automatic fire-extinguishing, comprising, a housing having a cylindrical hollow body portion with upper, lower, left-side and right-side openings, and said cylindrical hollow body having an upper opening and a lower opening and curved inner walls;

a pair of side covers attached bilaterally to said hollow body by means of respective locking pins, each said side cover having an axial bore and a bearing which has an axial bore, each of said bearings being coaxially arranged with the bore in its respective side cover;

a frame mounted on said housing and having an inlet which is in alignment with the upper opening of said cylindrical hollow body portion, and a plurality of curved radial grooves arranged around said inlet on said frame plate for temporary placement of burning cigarettes;

a container mounted beneath the housing for collection of ashes, cigarette butts and/or garbage;

a fastening element mounted inferiorly and externally on the housing and connecting the housing with the container;

a dust collecting drum having a core with a bore extending therethrough, said dust collecting drum being rotatably mounted inside the cylindrical body portion between the upper opening and the lower opening of the housing with its periphery closely in contact with the inner wall of the cylindrical hollow body portion;

said dust collecting drum having, a plurality of radial collecting chambers arranged around the core of the dust collecting drum, said collecting chambers of the dust collecting drum each having a broader radial outer opening than its radial inner bottom for facilitating the deposition of garbage contained inside said chambers;

a rotatable shaft, inserted through the bore of each side cover of the housing and through the bore of the dust collecting drum with both ends protruding beyond the respective side covers for controlling the rotating motion of the dust collecting drum;

a handle bar attached at each end of said rotatable shaft for operating said rotatable shaft;

wherein the structure of the ashtray is such that by means of the above-described arrangement, the inner space of the container is hermetically sealed so that any burning cigarette butt that has been thrown into a chamber will be promptly extinguished; and wherein each side cover has an air hole to facilitate the rotating of the dust collecting drum against the housing.

2. A structure of ashtray capable of self-cleaning and automatic fire-extinguishing as in claim 1, wherein the inner wall of each collecting chamber of the dust collecting drum is inclined outward to form a broader opening for rapid sliding of the ashes, cigarette butts and/or garbage that is contained inside said collecting chamber.

* * * * *